United States Patent [19]

Cox

[11] 4,285,082

[45] Aug. 25, 1981

[54] SURFBOARD SAFETY AND CONTROL ACCESSORY

[76] Inventor: William G. Cox, 5638 Montezuma Rd., San Diego, Calif. 92115

[21] Appl. No.: 69,817

[22] Filed: Aug. 27, 1979

[51] Int. Cl.[3] ..... A63C 5/00; A63C 9/00; A63C 11/00; A63C 15/00

[52] U.S. Cl. ..... 9/310 E; 9/310 AA; 9/6 P; 224/901; 114/39; 114/85

[58] Field of Search ..... 9/1.7, 310 R, 310 A, 9/310 AA, 310 B, 310 D, 310 E, 310 G, 310 J, 6 R, 6 P; 224/901; 24/204, 31 V; 114/39, 85; 280/87.04 A; 156/91

[56] References Cited

U.S. PATENT DOCUMENTS

| | | | |
|---|---|---|---|
| 3,050,751 | 8/1962 | Moon | 9/310 B |
| 3,593,356 | 7/1971 | Schmalfeldt | 9/310 E |
| 3,803,652 | 4/1974 | Uyehara | 9/310 E |
| 4,044,415 | 8/1977 | Wood | 9/310 E |
| 4,108,452 | 8/1978 | Baron | 280/87.04 A |
| 4,140,253 | 2/1979 | Vickers | 224/901 |

*Primary Examiner*—Trygve M. Blix
*Assistant Examiner*—D. W. Keen
*Attorney, Agent, or Firm*—Henri J. A. Charmasson

[57] ABSTRACT

Strips of material having on their top surfaces a large number of closely spaced flexible loops of resilient material, and a method for bonding such strip on the top riding surface of a surfboard. Strips of flexible material having on their top surface a large number of closely spaced hooking elements of resilient material which cooperate with said flexible loops are bonded to the chest area of a wet suit carried by the surfboard rider. The device prevents the rider from sliding off the board while paddling with face down on the board, against the surf.

9 Claims, 4 Drawing Figures

4
7
7
1

2

8
8
5

3
8

6

10
9
12
11
15
13
14

SURFBOARD SAFETY AND CONTROL ACCESSORY

BACKGROUND OF THE INVENTION

This invention is related to surfboard, sailboard and other water crafts having a top slick surface supporting the rider. Various devices have been used to help the rider of a surfboard or sailboard in keeping control of the board under his feet and maintain his balance thereupon. One method has been to install a resilient insert in the top surface of the board. An example of this approach is disclosed in U.S. Pat. No. 4,129,911, MacDonald, et al. Another approach has been to equip the top surface of the board with a stirrup-type device to be engaged by the rider's foot. An example of this second approach is disclosed in U.S. Pat. No. 3,593,356, Schmalfeltd. The first approach, however, gives the rider a very limited amount of frictional control over the board. The second approach tends to increase the drag of the surfboard and can create a very hazardous situation if the rider cannot quickly disengage his foot from the stirrup-type attachment. Neither one of the two improvements address the problem of increasing the frictional control over the surfboard when the rider is paddling face-down against the incoming surf.

The problem was partly resolved when this applicant conceived the idea of bonding hook-type Velcro® strips to the top riding surface of the sailboard, and applying hook-type Velcro® strips to the thoracic area on the wet suit to be worn by the rider. A high friction contact was thus established between the chest of the rider and the board which prevented the surfer from slipping off the board when paddling through a wave. However, no bonding agent could be found that would keep the Velcro® strips glued to the surfboard or sailboard for several weeks of daily exposure to seawater.

SUMMARY OF THE INVENTION

The principal object of the invention is to provide a means for permanently bonding a strip of Velcro® material to the top surface of a surfboard or sailboard which can cooperate with corresponding interlocking strips of Velcro® material applied to a part of a garment worn by the rider, in order to provide better frictional control of the board by the rider. Another purpose of the invention is to provide a means for achieving such a control in both a standing and lying position.

These and other purposes of the invention are achieved by sewing on the back of the Velcro® strip a webbing made of a fiberglass mesh which can be imbedded in the fiberglass surface of the surfboard. A similar technique is used to bond corresponding interlocking Velcro® strips to the surface of a garment worn by the rider.

BRIEF DESCRIPTION OF THE DRAWING

FIG. 4 is a perspective view illustrating the method of bonding Velcro® strips to the surface of a surfboard or the like.

DESCRIPTION OF THE PREFERRED EMBODIMENT OF THE INVENTION

Figure 1:
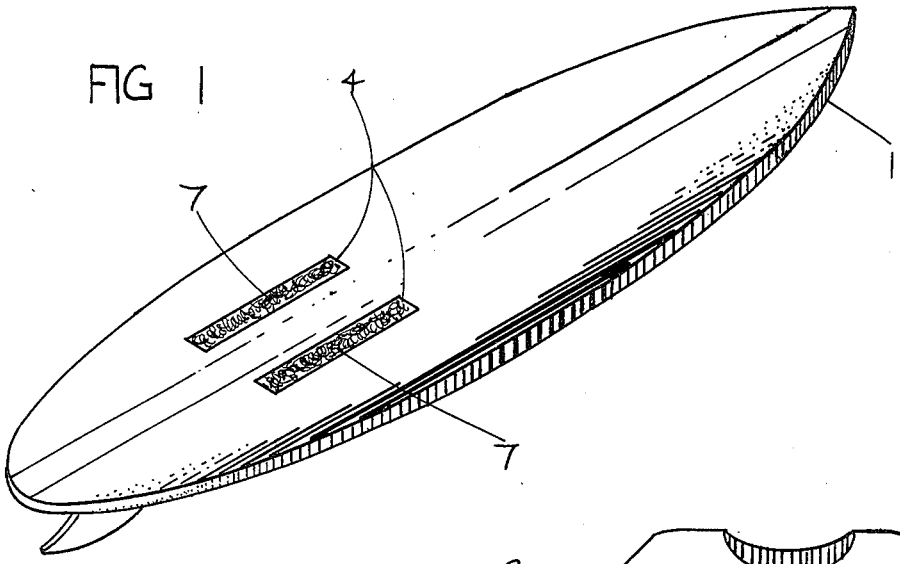
FIG. 1 is a perspective view of a surfboard modified according to the invention.
Figure 2:
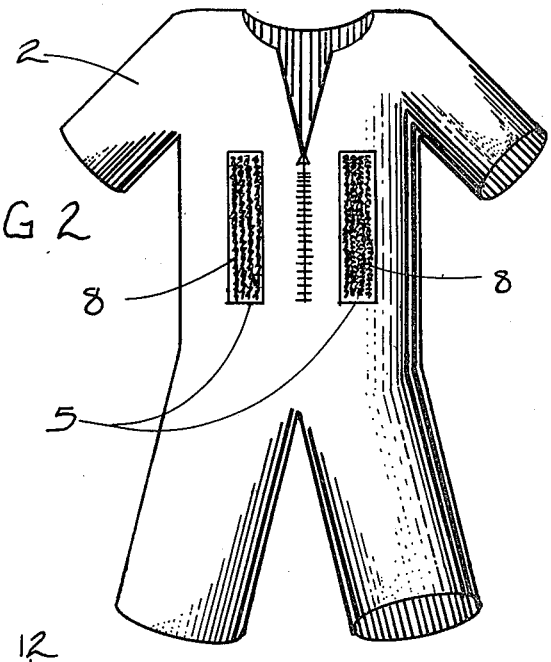
FIG. 2 is a front elevational view of a surfer wet suit modified according to the invention.
Figure 3:
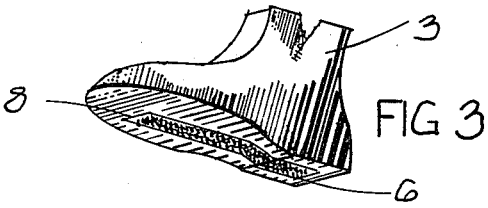
FIG. 3 is a bottom perspective view of a bootie to be worn by a surfboard rider modified according to the invention.

Referring now to the drawing and according to the invention, there is illustrated means for establishing a high friction, releasable bond, between parts of certain garments 2 and 3 worn by a surfer and the top surface of a surfboard 1. As more specifically illustrated in FIG. 1, two or more strips 4 of Velcro® material are mounted on the rear half top surface of the sailboard 1. Each strip comprises a tightly woven nylon web covered by a very large number of closely spaced flexible loops of resilient material. As more specifically shown in FIG. 2, the front of the wet suit 2 is equipped with two or more strips 5 of Velcro® material of a type which can interlock with the strips 4 mounted on the surfboard 1. This second type of Velcro® material comprises a nylon web supporting a very large number of closely spaced hooking elements 8 made of a resilient material. FIG. 3 illustrates the application of a similar strip 6 of material to the sole of a bootie worn by the surfboard rider. The Velcro® strips 5 on the face of the wet suit 2 are particularly useful when the surfboard rider is paddling back, face down, on the board, against the surf toward the open sea. The position of the strips 5 on the wet suit and those 4 on the surfboard, as well as the number of strips to be used on each implement, will be dictated by the size and shape of the surfboard, as well as the size of the rider and his preferred riding position.

Figure 4:
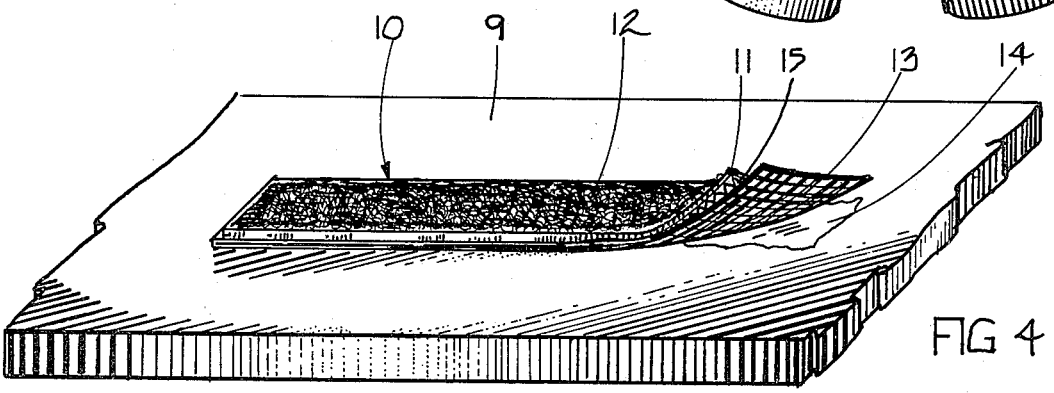

The bootie 3 with the Velcro® strip 6 bonded to the sole is designed to provide the rider with better control over the surfboard by providing a positive high frictional contact between his foot and the top surface of the board. Velcro® strips could also be installed in other parts of the garment worn by the rider such as the seats of the pants or the knees, depending upon the riding style. It should also noted that the manner in which the link between the cooperating strips can be quickly separated does not present the safety hazard encountered in other types of more positive linkage between the rider and the board. FIG. 4 illustrates the method used to secure either type of Velcro® strip to the top surface of the surfboard 1. The repeated exposure of the devices to salt water preclude the use of most gluing agents.

Each type of Velcro® strip 10 is made of a tightly woven nylon web 11 supporting an array of hook-type or loop-type material 12. In order to bond the back of the nylon web 11 to the top surface 9 of a fiberglass surfboard, the Velcro® strip 10 is sewn to a web 13 made of fiberglass mesh by means of a nylon thread 15. The fiberglass web 13 is then imbedded in the surface 9 of the surfboard during the original fabrication process before the fiberglass resin has dried up; or by applying a new layer of fiberglass resin 14 on the top surface 9 of the surfboard in the area to be covered by the Velcro® strip 10.

The same technique can be used, for instance, to apply a strip of Velcro® material to the outside surface of a wet suit or bootie made of rubber, except that instead of sewing the strip to a web of fiberglass, it is sewn to a web made of rubber or rubber-coated threads. The Velcro® strips can be installed while the rubber surface is still hot and malleable, or by means of a rubber based bonding compound which when dry would be whole with the surface of the wet suit or the sole of the bootie.

While I have described the preferred embodiment of my invention and suggested modifications thereto, other modifications can be made without departing from the spirit of the invention and the scope of the appended claims.

What is claimed is:

1. In combination with a water craft, or the like, designed for supporting a rider, a safety device which comprises:

a first element of a releasable fastening means permanently installed on the riding surface of the craft;

a second element of said releasable fastening means permanently installed on the outside surface of a garment worn by said rider; and said fastening means comprising cooperating strips of woven fabric having interconnecting surfaces, said first element comprising a mesh made of the same material as the top portion of the craft and including means for fastening said mesh to the undersurface of said strip such that said mesh is imbedded in the top surface of said craft.

2. Structure according to claim 1 wherein engagement of said releasible fastening means is effected by compressive force and said second element is fastened on the portion of the outside surface of a garment which, under conditions of normal use, is pressed against said water craft by the rider.

3. The combination claimed in claim 2 wherein one of said elements is installed in the outside pectoral area of the wet suit.

4. Structure according to claim 2 wherein the first and second elements of said releasable fastening means are mutually engageable and disengageable at any point of mutual contact by the respective application of compression or separative forces, and said watercraft is a surfboard and said garment is a wetsuit, whereby a surfer can multipositionally and adjustably secure himself to the surfboard during use.

5. The combination claimed in claim 1 wherein said second element comprises a second mesh made of the same material as the outside surface of said garment;

means for fastening said mesh to the undersurface of said second element; and means for bonding said mesh to the outside surface of said garment.

6. The combination claimed in claim 5 wherein said craft is a surfboard and said garment is a wet suit.

7. The combination claimed in claim 6 wherein said first and second elements comprise cooperating strips of Velcro ® material.

8. A method for bonding a strip of Velcro ® material to a surfboard-like object having a resinous fiberglass surface which comprises;

securing a mesh made of fiberglass filaments to the back of the strip; and bonding said mesh to said surface with fiberglass resin during the fabrication process of the object by imbedding said mesh in the resinous surface before it hardens.

9. The method claimed in claim 8 wherein said bonding is made during the fabrication process of the object by imbedding said mesh in the resinous surface before it hardens.

* * * * *